United States Patent [19]

Thykeson

[11] Patent Number: 5,036,983

[45] Date of Patent: Aug. 6, 1991

[54] CARTON POUR CLOSURE

[75] Inventor: Everett Thykeson, San Ramon, Calif.

[73] Assignee: The Clorox Company, Oakland, Calif.

[21] Appl. No.: 568,960

[22] Filed: Aug. 17, 1990

[51] Int. Cl.[5] ..... B65D 5/70

[52] U.S. Cl. ..... 206/621.4; 206/621.7

[58] Field of Search ..... 206/621.3, 621.4, 621.7, 206/626

[56] References Cited

U.S. PATENT DOCUMENTS

| | | | |
|---|---|---|---|
| 1,956,238 | 10/1903 | Jackson . | |
| 2,330,926 | 10/1943 | Rous . | |
| 2,340,651 | 2/1944 | Denison . | |
| 2,819,831 | 1/1958 | Polarek et al. | 206/621.7 |
| 3,104,793 | 9/1963 | Hickin | 206/621.7 |
| 3,133,689 | 5/1964 | Rossi | 206/621.7 |
| 3,270,941 | 9/1966 | Barnes . | |
| 3,438,555 | 4/1969 | LaPierre . | |
| 3,814,301 | 6/1974 | Niepmann . | |
| 4,809,853 | 3/1989 | Weber . | |

FOREIGN PATENT DOCUMENTS

| | | | |
|---|---|---|---|
| 730539 | 3/1966 | Canada | 206/621.3 |
| 2804812 | 8/1979 | Fed. Rep. of Germany | 206/626 |
| 1049684 | 11/1966 | United Kingdom | 206/621.3 |

OTHER PUBLICATIONS

"Handbook of Folding Carton Style Nomenclature", Paperboard Packaging Council, 1988.

*Primary Examiner*—Gary E. Elkins

*Attorney, Agent, or Firm*—Majestic, Parsons, Siebert & Hsue

[57] ABSTRACT

The invention comprises a closure for carton board containers which is an extension of the top flap. A dispensing opening is partially die cut through an end wall of the container, thereby forming an opening with a removable plug. The plug is glued to the closure flap so that it comes away with and is a functional part of the closure flap. A locking tab depends from a lower edge of the closure flap and is spot glued to the end wall when the container is initially filled. The closure is initially opened by pulling on the tab and breaking the spot seal. A pair of score lines extend across the closure flap on the one hand and adjacent to the tab on the other to facilitate closing and locking. In an alternate embodiment, an additional top mirror end flap is provided to enhance carton sealing and product containment.

10 Claims, 4 Drawing Sheets

CARTON POUR CLOSURE

FIELD OF THE INVENTION

This invention is directed to an improved closure for a carton. In particular, the invention is directed to a container pour closure for a carton board box container.

BACKGROUND OF THE INVENTION

There are many carton closures in the prior art that function to selectively close off a carton container dispensing opening. Typically, such carton containers are box-shaped and hold dry granular materials which flow freely through the dispensing opening. Such materials may include laundry detergent or the like. Also typically, the container opening is located on the side wall near its top or actually in the top.

Some prior art containers include a pour spout which is actually a separate piece from the carton board container. The spout thus described may be made of metal material such as aluminum. It is ramp-shaped and is movably fitted into the dispensing opening in the side of the container, and may be articulated from a closed position, where it is in the same plane as the container side wall, to an opened position where it forms a pour spout. A disadvantage of this prior art structure is that it requires an extra manufacturing step and additional non-carton board material. This all adds to unwanted cost.

A partial solution to the disadvantage thus posed is found in the structure shown in U.S. Pat. No. 3,438,555 issued to La Pierre on Apr. 15, 1969. With this patented device, a pour spout is formed from the carton board material of a flap extension. However, this still requires extra manufacturing steps, extra board material, and consequently extra cost.

Another type of container closure is shown in U.S. Pat. No. 3,814,301 issued June 4, 1974 to Niepman. With this container, the opening is in the top and a flap extends down over the adjacent side wall. A lateral holding nose or tab extends from the flap and engages the container. This structure has the advantage that the flap is an integral extension of the top flap. However, this structure is complicated, requires extra board material and thus is costly to manufacture.

Still another container closure of note is found in U.S. Pat. No. 1,956,238 issued on Apr. 24, 1934 to Jackson. This patent discloses a dispensing carton board container having a flap which is an extension of the top flap and which extends down over the adjacent side wall in a manner similar to the immediately preceding patent structure. However, a second flap is formed in the side wall with a fold line at the juncture with the top. This second flap is formed by making an arcuate die cut in the side wall adjacent to the top. A problem with this type of structure is that the location of the second flap at the juncture may cause weakening of the container.

A similar structure to that described immediately above is shown in U.S. Pat. No. 3,104,793 issued to Hickin on Sept. 24, 1963. Again, the location of the juncture of the second or inner flap with the top may cause weakening of the structure.

SUMMARY AND OBJECTS OF THE INVENTION

It is a principal object of the invention to provide an improved closure for a container of the carton board type.

It is a further object to provide a container closure for a carton board type of container that is an integral part of the carton and that does not require any separate manufacturing step to create or insert a spout.

It is a further object to provide a container closure that may be sealingly reclosed and locked.

It is a further object to provide such a closure that is an extension of the top flap and which does not require an additional panel to form.

It is a still further object to provide such a closure that provides enhanced sealing of the container and wherein the dispensing opening is away from the corners and edges of the container so as to avoid weakening.

The invention takes the form of a closure flap for carton board containers or the like which is an extension of the top flap, thereby eliminating an additional panel. A dispensing opening is diecut in an end wall of the container, which forms a plug for the opening. This plug is glued to the closure flap so that it comes away with and is a functional part of the closure flap. A locking tab extends from the closure flap and is spot glued to the end wall when the container is initially filled. By grasping and pulling away the tab from the end wall, the closure is initially opened. Score lines on the closure flap enable the plug to be re-inserted and sealed within the dispensing opening while at the same time locking the closure by means of the tab being located within the interior of the container.

DETAILED DESCRIPTION

Figure 1:
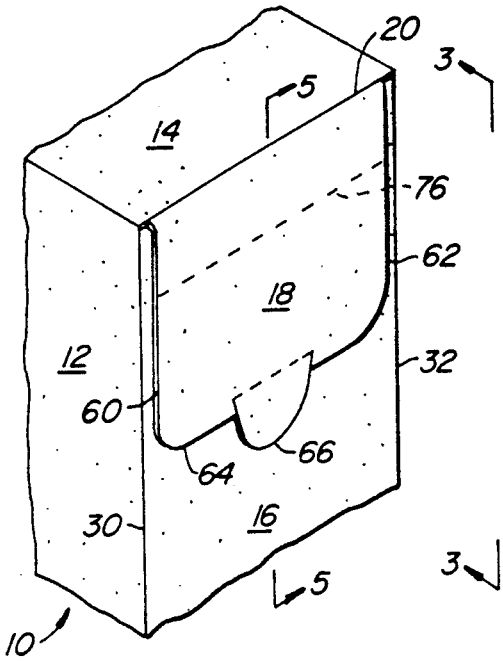
FIG. 1 is a top quarter isometric view of the upper portion of a carton or box container illustrating the closure of the instant invention in the fully closed position.

As seen in the drawings, there is shown at FIG. 1 a preferred embodiment of the invention in the form of a carton or box container 10. Side panel or wall 12 joins with top flap 14 and end wall 16 to make up the container corner shown. A closure flap 18 is an extension of top flap 14 and bends downwardly at score line 20. In this manner, closure flap 18 is in close sealing contact with end wall 16 when the closure flap is in the closed condition, as will be more fully described hereinafter.

Figure 10:
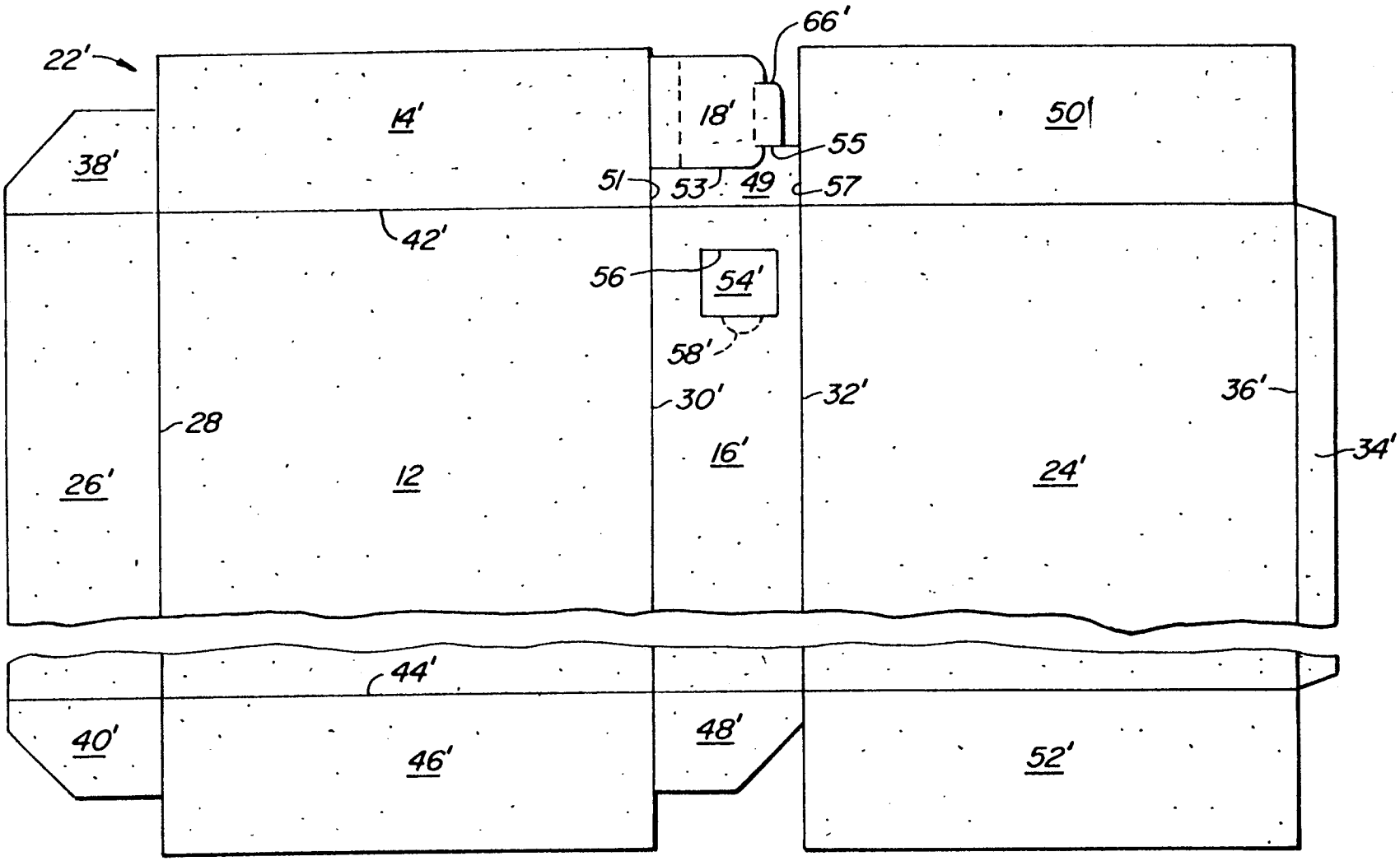
FIG. 10 is a view similar to FIG. 9 showing an alternate embodiment of the blank.

Turning now to FIG. 10, the blank 22 from which the container is made is shown in its original flattened form. The foldable blank may be made of flexible sheet material such as carton board. Blank 22 includes a pair of side walls 12, 24 and a pair of end walls 16, 26. End wall 26 is integrally joined to side wall 12 along scored fold line 28. Similarly, end wall 16 is integrally joined to side walls 16 and 24 at fold lines 30, 32, respectively. A glue flap 34 is integrally joined to side wall 24 at fold line 36.

Top and bottom end flaps 38, 40 are integrally joined to end wall 26 along top and bottom fold lines 42, 44, respectively. Similarly, top flap 14 and bottom flap 46 are joined to side wall 12 along top and bottom fold lines 42, 44, respectively. Still further, bottom end flap 48 is joined to end wall 16 at bottom fold line 44. Also, top glue flap 50 and bottom glue flap 52 are integrally joined to side wall 24 along top fold lines 42, 44, respectively. Finally, and as aforementioned, closure flap 18 is integrally connected to top flap 14.

Blank 22 is formed into generally tubular shape as a first step in forming the box container. Glue flap 34 is then adhered to the back or inner side of end wall 26 by means of a suitable adhesive. Top end flap 38 is then bent at right angles to the plane of end wall 26. Similarly, bottom end flap 48 is also so bent. Bottom glue flap 52 is then bent to right angles with respect to the plane of side wall 24 and so as to be in contact with bottom end flaps 40, 48. Bottom end flap 46 is then bent along fold lines 44 until it contacts bottom glue flap 52. A suitable adhesive is used to secure bottom flap 46 to bottom glue flap 52.

Granular or powdered material such as detergent is then poured into the open end of the container until it is suitably full. Top end flap 38 is then bent to be at a right angle to end wall 26. Top glue flap 50 is also so bent to be at a right angle to side wall 24 along fold line 42. An adhesive is applied and top flap 14 bent so as to contact and adhere to top glue flap 50.

A generally square plug 54 has been prescored near but not immediately adjacent top fold line 42 on end wall 16. Plug 54 is also spaced from fold lines 30 and 32. Line 56 is cut clear through the end wall 16 while the other sides of plug 54 are perforated so that plug 54 remains in place until opened for dispensing. Adhesive is placed on plug 54 as well as within an area 58 outside and below the plug 54. Closure flap 18 is then bent along fold line 20 to contact side wall 16 including plug 54 and area 58. In this manner, closure flap 18 is adhered to plug 54 and to end wall 16 in the spot of area 58, as well as in the area on end wall 16 between score line 76 and top flap 14.

Figure 2:
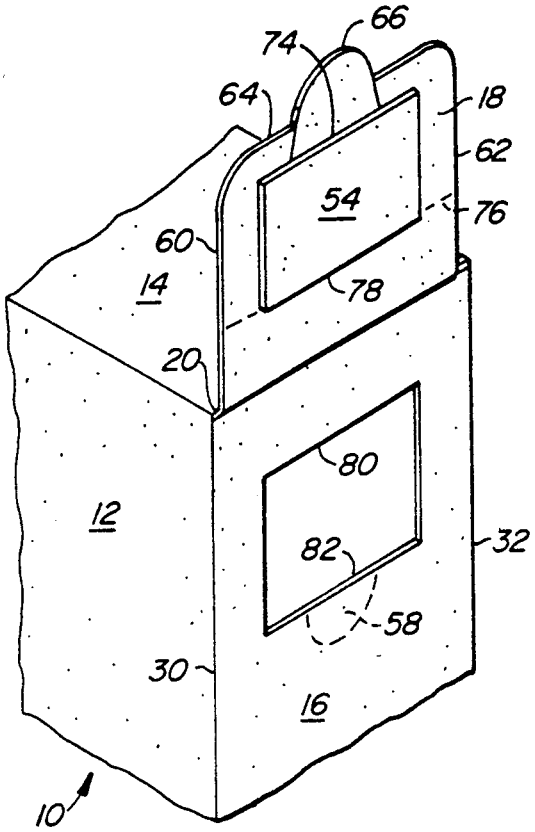
FIG. 2 is a similar view illustrating the closure in the opened condition or position so as to provide a dispensing opening.
Figure 3:
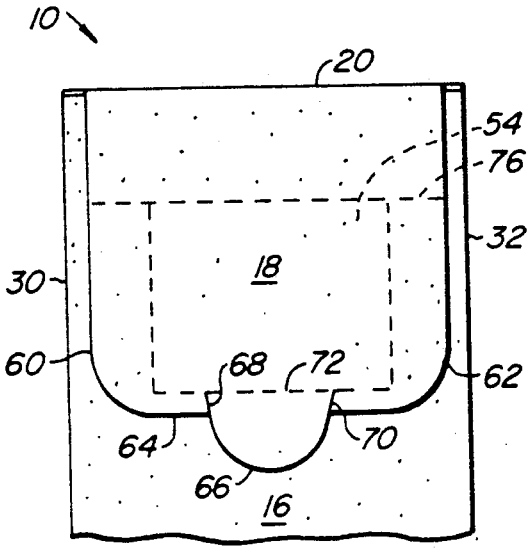
FIG. 3 is an enlarged fragmentary elevation view taken in the direction 3—3 in FIG. 1.

Returning to FIG. 1, it may be noted that closure flap 18 may be slightly narrower than the width of end wall 16. Its side edges 60, 62 are spaced, not necessarily symmetrically, from the corners formed by fold lines 30, 32. Closure flap 18 also has a bottom edge 64 which is perpendicular to side edges 60, 62 and parallel to fold line 20. The closure flap is cut so as to produce a depending locking tab 66. The locking tab 66 may be of any convenient shape, such as semi-circular, square, rectangular, etc. Cut lines 68, 70, which are extensions of the curve of tab 66, extend part way into closure flap 18 and have their uppermost extensions joined by a score line 72. As seen in this figure and in FIGS. 2 and 3, score line 72 is approximately in line with the lower edge 74 of plug 54.

Figure 4:
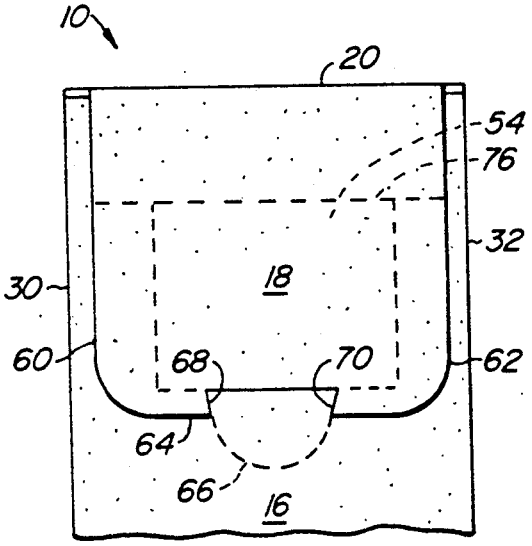
FIG. 4 is a view similar to FIG. 3 showing the locking tab fully engaged.

Another score line 76 extends across the entire width of the closure flap 18 spaced from and below fold line 20. It is approximately in line with the upper edge 78 of plug 54. FIG. 4 shows the locking tab 66 in the fully locked position or condition.

Figure 5:
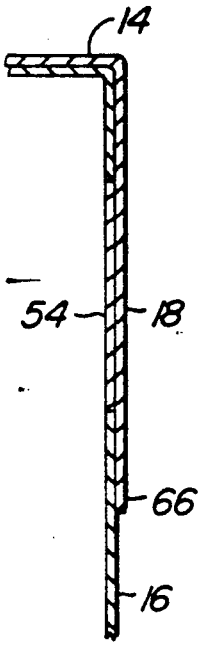
FIG. 5 is an enlarged fragmentary sectional view in a plane taken along the lines 5—5 in FIG. 1.
Figure 6:
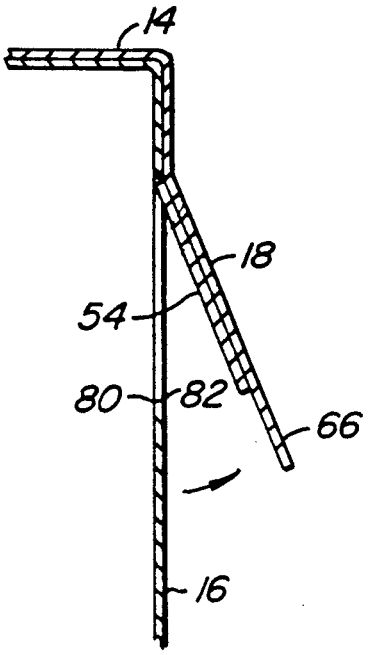
FIG. 6 is a view similar to FIG. 5 showing the closure flap being articulated away from the dispensing opening.

As shown in FIGS. 5–8, the steps in going from the initial to the fully closed and locked condition are illustrated. In FIG. 5, tab 66 is first grasped and pulled away from end wall 16, breaking the small amount of adhesive in the area 58 shown in FIG. 9. Plug 54 will be thereby pulled out of its sealing position and come away with closure flap 18. FIG. 6 illustrates a continuation of this process, which creates a dispensing opening 80 in side wall 16 suitable for dispensing the granular product contained in the container.

Figure 7:
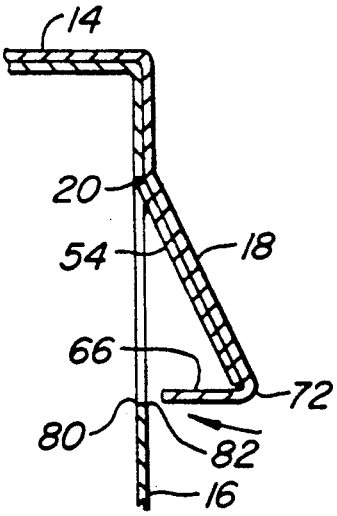
FIG. 7 is a similar view but showing the closure bent along a score line so that it may be inserted into the dispensing opening for locking.
Figure 8:
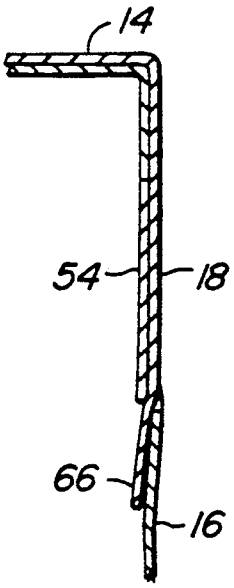
FIG. 8 is a similar view showing the closure fully engaged in the opening with the locking tab securing it therein.
Figure 9:
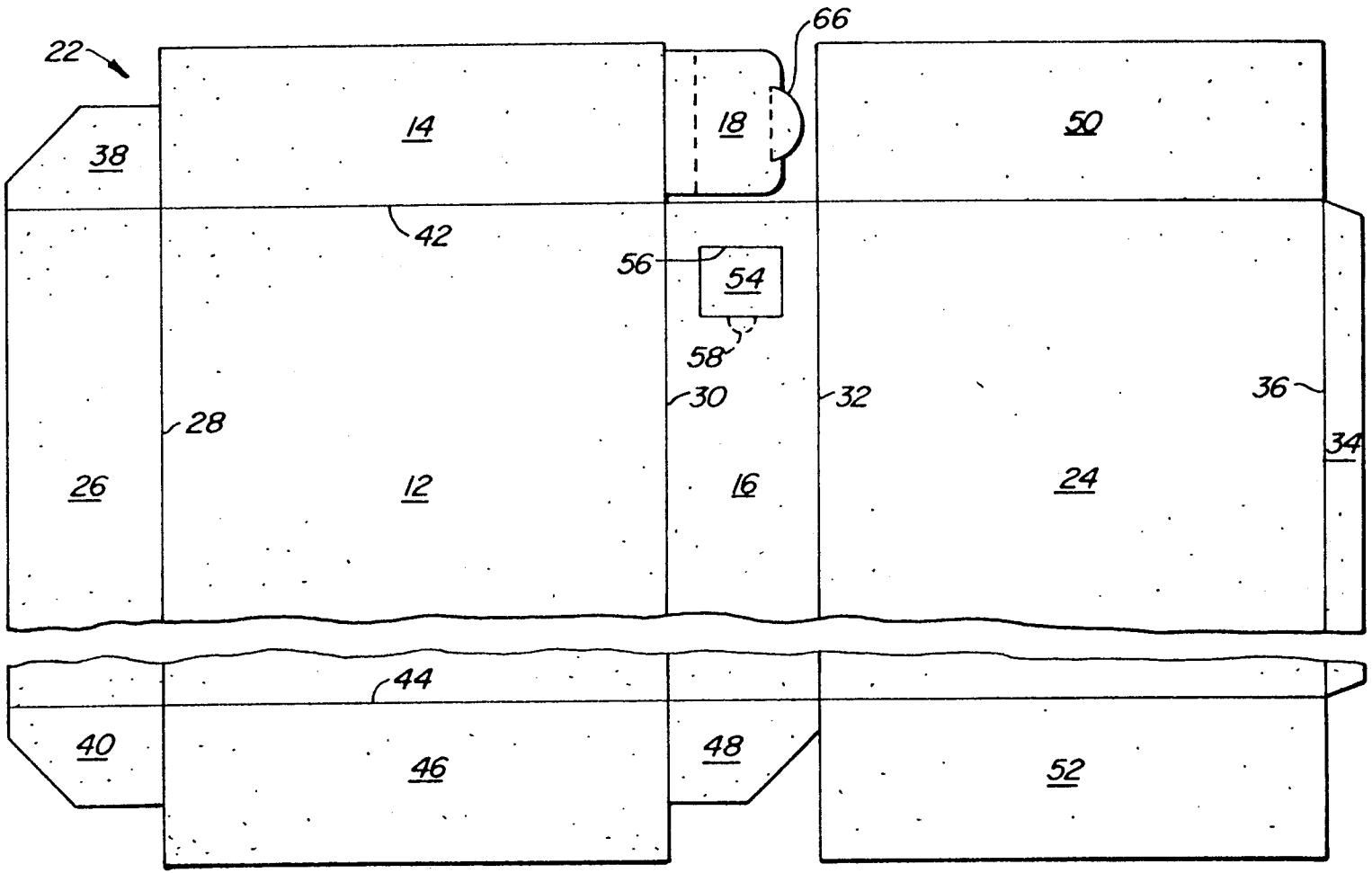
FIG. 9 is a fragmentary top plan view of the blank from which the carton is formed.

After dispensing, the closure is bent at score line 72 and inserted into opening 80, as seen in FIG. 7. Tab 66 is then inserted into the opening so that it contacts and rides against lower edge 82 of opening 80. By manual pressing on closure flap 18, plug 54 will be re-sealed into opening 80 while at the same time locking tab 66 will be positioned within the container as shown in FIGS. 4 and 8. For further dispensing, closure flap 18 is merely grasped and pulled away from wall 16 and locking tab 66 will be disengaged.

An alternate embodiment of the invention is shown in FIG. 10, wherein structure corresponding to the first embodiment is designated by a prime. With this embodiment, a top minor end flap 49 is connected to end wall 16'. Top minor end flap 49 is formed by means of cut lines 51, 53, 55, 57 in the blank. The presence of this top minor closing flap 49 enhances carton sealing and product containment. Closure flap 18' is located slightly asymmetric with respect to top flap 14'. Parenthetically, top minor end 49 is bent at a right angle to end wall 16' and is glued between top flap 14' and top glue flap 50' in like manner to and at the same time as top end flap 38'. Plug 54' is correspondingly asymmetrically located.

As is seen, tab 66' is of generally rectangular shape as opposed to the generally semi-circular shape of the tab of the first embodiment.

It is to be understood that, while the invention has been described above in conjunction with the preferred specific embodiment thereof, the description is intended to illustrate and not limit the scope of the invention, which is defined by the scope of the appended claims.

I claim:

1. A carton container of sheet material comprising a first wall which is at least partially cut through to provide a dispensing opening with a plug formed in the opening, said carton further comprising a second wall having a closure flap extending therefrom and adapted to contact said first wall and cover said opening in said first wall, means securing said plug to said closure flap so that said plug is removable from said dispensing opening incident to removing said closure flap from contact with said first wall, and locking means on said closure flap for locking said plug within said opening whereby the container may be closed and re-opened for subsequent dispensing of material from the container, wherein said locking means comprises a tab projecting from said closure flap which is engageable within said dispensing opening, and a score line on said closure flap so that said closure flap may be bent, thereby facilitating insertion of said tab in said dispensing opening for closing, wherein said closure flap defines a pair of lateral side edges and a bottom edge, said tab depending from said bottom edge, and wherein said score line extends laterally between said lateral side edges.

2. The invention of claim 1 further including a top minor end flap extending from said first wall, which end flap is attached to said second wall thereby enhancing container sealing and product containment.

3. The invention of claim 1 further including cut lines on said closure flap which are extensions of the sides of said tab, said cut lines extending part way into said closure flap to points defining uppermost extensions thereof.

4. The invention of claim 3 further including means defining a score line on said closure flap between said cut lines.

5. The invention of claim 4 wherein said score line between said cut lines joins said cut lines between their uppermost extensions.

6. The invention of claim 1 wherein a top edge of said closure flap is defined by a fold line between said second wall and said closure flap, and wherein said score line is spaced from said fold line.

7. The invention of claim 6 wherein said score line is in line with an upper edge of said plug.

8. The invention of claim 1 wherein said first wall defines length and width and wherein said closure flap is narrower than said first wall.

9. A carton container of sheet material comprising a first wall which is at least partially cut through to provide a dispensing opening with a plug formed in the opening, said carton further comprising a second wall having a closure flap extending therefrom and adapted to contact said first wall and cover said opening in said first wall, means securing said plug to said closure flap so that said plug is removable from said dispensing opening incident to removing said closure flap from contact with said first wall, and locking means on said closure flap for locking said plug within said opening whereby the container may be closed and re-opened for subsequent dispensing of material from the container, said locking means comprising a tab projecting from said closure flap and a score line on said closure flap for bending said closure flap, said closure flap further comprising a pair of lateral side edges and a bottom edge, said tab depending from said bottom edge, said tab having sides extended as cut lines which extend part way into said closure flap.

10. The invention of claim 1 wherein said first wall defines length and width and wherein said closure flap has substantially the same width as said first wall.

* * * * *